United States Patent [19]

Taylor

[11] Patent Number: 4,540,330

[45] Date of Patent: Sep. 10, 1985

[54] LOAD ROTATING ATTACHMENT FOR LIFT TRUCKS

[75] Inventor: William L. Taylor, Jackson, Mich.

[73] Assignee: The Knickerbocker Company, Jackson, Mich.

[21] Appl. No.: 590,282

[22] Filed: Mar. 16, 1984

[51] Int. Cl.[3] ..... B65F 9/14

[52] U.S. Cl. ..... 414/641; 74/105; 414/422

[58] Field of Search ..... 414/620, 640, 641, 672, 414/421, 422, 642, 705; 74/105

[56] References Cited

U.S. PATENT DOCUMENTS 3,143,233 8/1964 Evans et al. ..... 414/620

4,095,714 6/1978 Schuster ..... 414/641 X

*Primary Examiner*—Robert G. Sheridan

*Attorney, Agent, or Firm*—Barnes, Kisselle, Raisch, Choate, Whittemore & Hulbert

[57] ABSTRACT

A load rotating attachment for a lift truck provided with an elevating carriage has a back plate sub-assembly including an upright wall adapted to be secured to the carriage adjacent and forwardly thereof. A front plate sub-assembly has an upright wall juxtaposed to the back plate wall and pivotally mounted thereon for rotation relative thereto with the major planes of the walls in parallelism. An upright framework is fixed to and extends above the back plate wall and supports a hydraulic ram thereon. A fixed upright of the framework serves as a guide track for a movable guide having a roller arm with guide rollers supported thereon for tracking on the guide track. The piston rod of the ram is pivotally connected to a drive link which in turn is pivotally coupled between and to said movable guide and to the rotatable front wall for bodily travel and pivotal motion in a path extending partially around and radially offset from the pivotal mounting of the front and back walls. This produces a 180° rotation of the front wall and associated load-carrying forks. The forks are removably attachable for mounting in load carrying attitude on the front wall in either its 0° or 180° position to provide left-hand or right dumping of the load. The front and back plate walls have spacers disposed therebetween for maintaining the walls generally in parallelism against load induced bending moments exerted on said front plate assembly. Rotational lock-up and fork and carriage safety mounts are also provided.

19 Claims, 19 Drawing Figures

20°

130°

180°

LOAD ROTATING ATTACHMENT FOR LIFT TRUCKS

This invention relates to industrial and rough terrain lift trucks, and more particularly to load rotating attachments to be carried on the load lifting carriage of such trucks for receiving and raising a load, for changing the position of the load by bodily rotation thereof and for dumping or depositing the load.

Industrial and rough terrain lift trucks for handling and transporting loads from place to place in manufacturing, construction and agricultural are presently well known. Such lift trucks conventionally are provided with a load lifting carriage movably vertically on a single or multiple-stage extensible mast supported on the vehicle framework. Various general purpose and specialty load-engaging attachments are available for use on the carriage, such as lifting forks and the like, adapted to engage a load for lifting, stacking, transport, etc. of the same.

More specifically, one type of such attachment, to which the present invention relates, has a fork support assembly rotatable from a position with the forks in a substantially horizontal plane to a position in which the forks are rotated substantially bodily through various ranges such as zero to ninety up to zero to 360° in order that, for example, a tote box mounted on the lifting forks may be readily dumped. A variety of such load rotating attachments have been developed in the prior art. See, for example, U.S. Pat. Nos. 2,281,004 Lehmann et al, 2,522,128 Lehmann, 2,541,268 Milz, 2,585,095 Daniels, 2,979,217 Tomasovich, 3,039,631 Baker, 3,086,670 Cuendet, 3,688,929 McIntyre and 3,825,140 Smith.

However, such prior art load rotating attachments have either not been capable of fully inverting the load, i.e., capable of rotating the load through 180°, or if having such capability, have involved relatively complicated and expensive load rotating mechanisms with attendant higher cost of manufacture, operation and maintenance.

Accordingly, it is a principal object of this invention to provide a simple and effective load rotating attachment adapted for conventional mounting on the lift carriage of a lift truck capable of 180° rotation of the load.

Another object of the invention is to provide a unitary load rotating attachment which may be interchangeably mounted with a conventional fork carriage on the telescopic hoist assembly of both conventional and rough terrain lift trucks, and which can be quickly attached and be removed by one man after the initial installation of the dealer or purchaser.

A further object is to provide attachment of the above character wherein the rotation direction can be field changed by removing forks and reversing their position on a mounting plate of the attachment to thereby enable the rotator to dump to the operator's left or to his right.

Still another object of the invention is to provide an attachment of the above character which is substantially less expensive than the prior art load-rotator attachments, and which provides smooth hydraulic operation without employing gears, ratchets or chains in the drive mechanism.

Other objects of the invention, as well as advantages and features thereof, as set forth in the following detailed description taken in conjunction with the accompanying drawings (which are generally to scale) wherein:

FIG. 1 is a front perspective view of a conventional rough terrain lift truck with an associated telescopic mast and carriage mounted on the front end thereof, to which a preferred and commercially proven but exemplary embodiment of the improved load rotating and lifting attachment of the present invention has been attached for operation, the load lifting forks on the attachment being shown in a horizontal or zero degree load transporting and/or lifting position.

Figure 5:
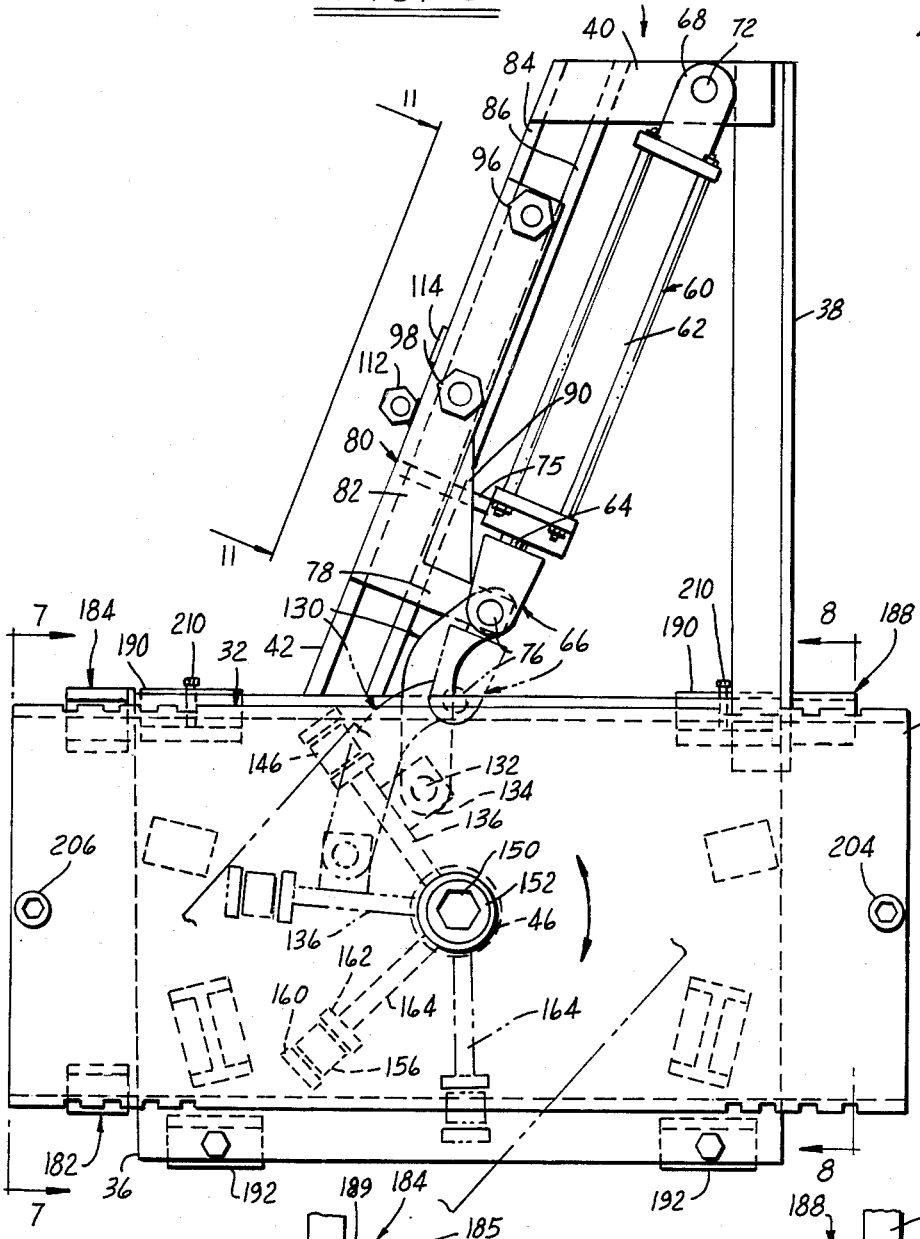
FIG. 5 is a front elevational view of the load rotating attachment of FIGS. 1–4 but shown separate and apart from the lift truck.
Figure 7:
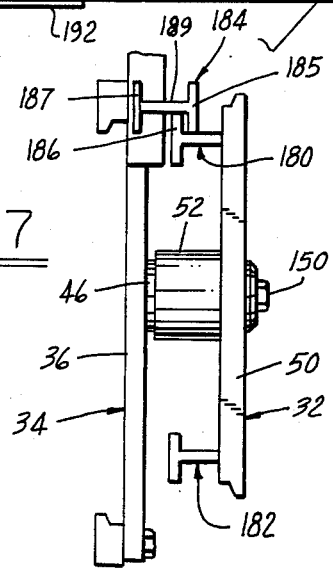
Figure 8:
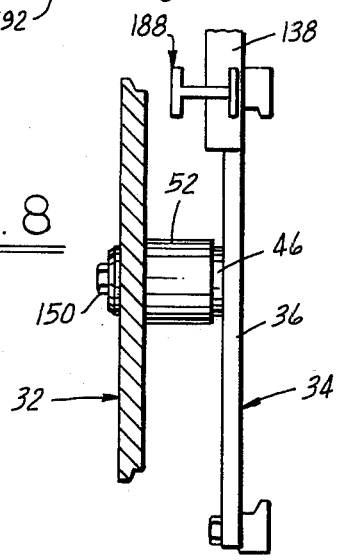

FIGS. 7 and 8 are fragmentary end views of the attachment of FIG. 5 taken on lines 7—7 and 8—8 respectively of FIG. 5.

Figure 9:
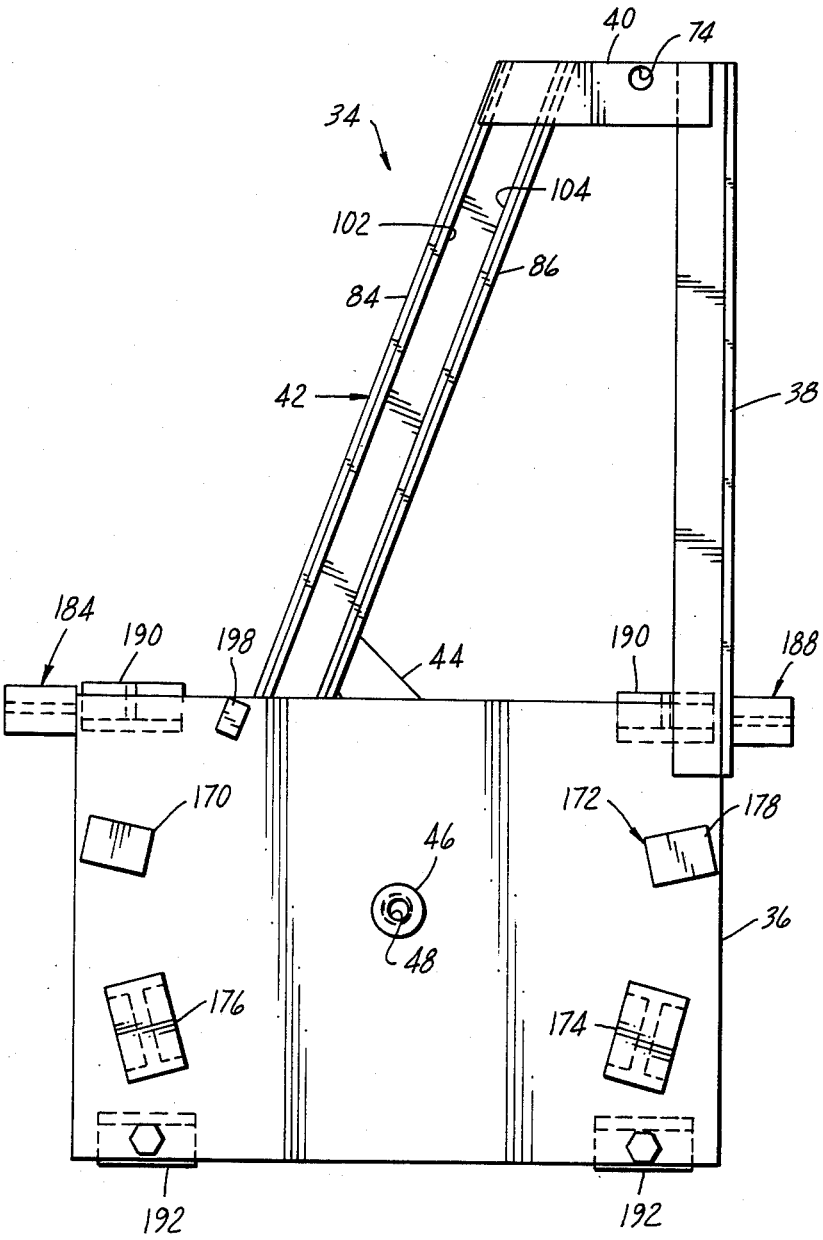

FIG. 9 is a front elevational view of the back plate and frame sub-assembly of the attachment shown in FIGS. 1–8.

Figure 10:
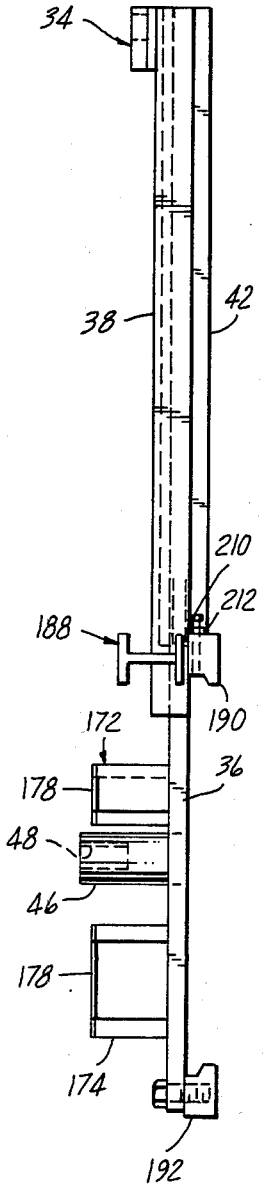

FIG. 10 is a side elevational view of the sub-assembly shown in FIG. 9.

Figure 11:
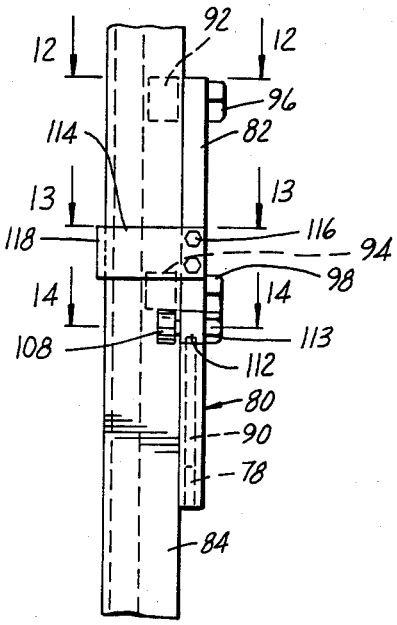

FIG. 11 is a fragmentary front elevational view of a movable ram-guide sub-assembly of the load rotating mechanism of the attachment, taken on the line 11—11 of FIG. 5.

Figure 12:
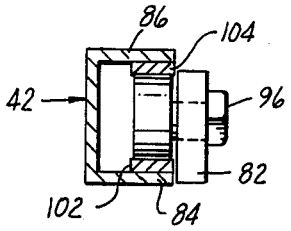
Figure 13:
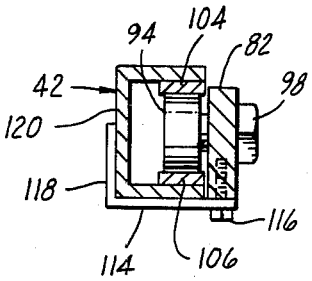
Figure 14:
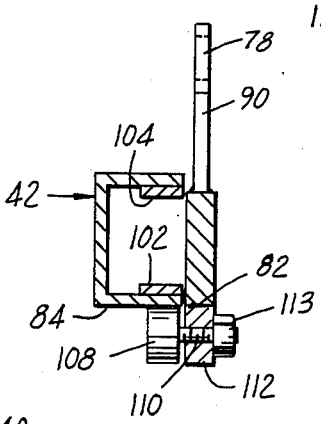

FIGS. 12, 13 and 14 are horizontal cross sectional views taken respectively on the lines 12—12, 13—13 and 14—14 of FIG. 11, and slightly enlarged thereover.

Figure 15:
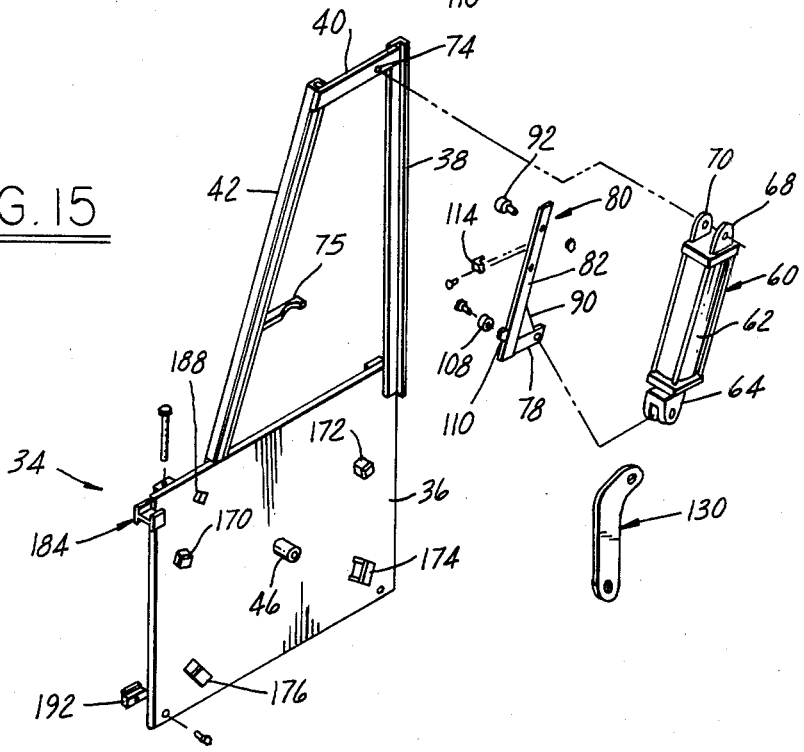

FIG. 15 is an exploded simplified perspective view of the back plate and frame sub-assembly and associated ram and guide load rotating mechanism of the attachment.

Figure 16:
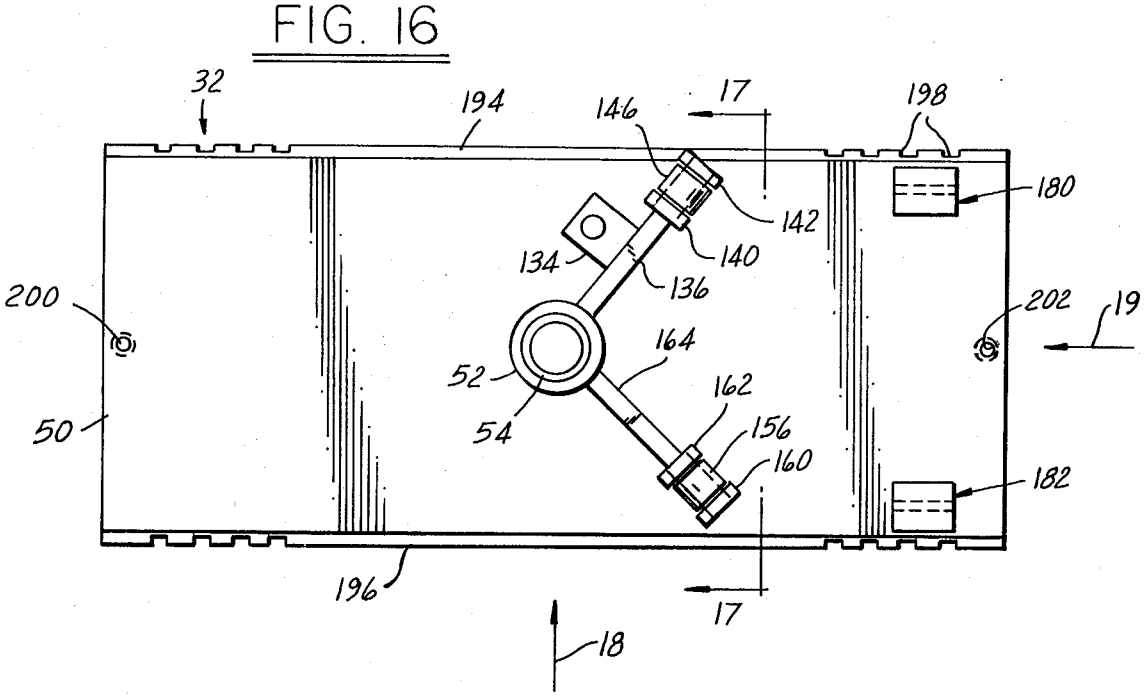

FIG. 16 is a rear elevational view of a front plate sub-assembly of the attachment shown in FIGS. 1–8.

Figure 17:
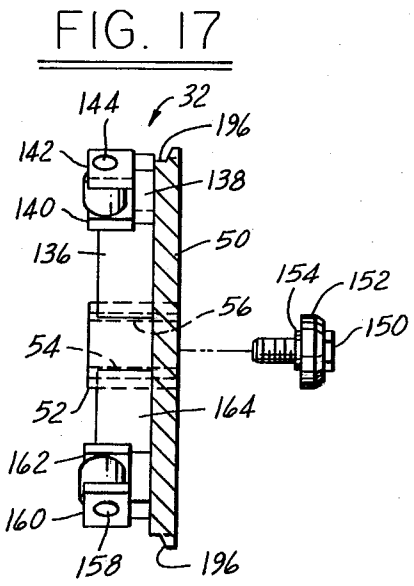

FIG. 17 is a vertical cross sectional view taken on the line 17—17 of FIG. 16.

Figure 18:
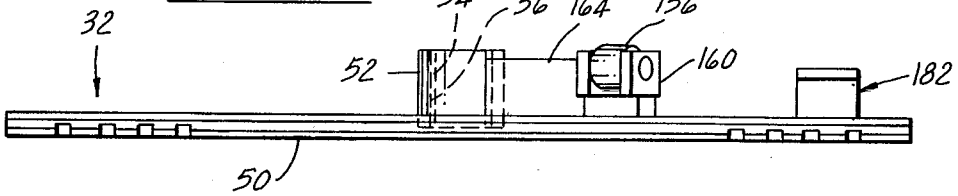

FIG. 18 is a bottom view of the front plate sub-assembly as viewed in the direction of the arrow 18 of FIG. 16.

Figure 19:
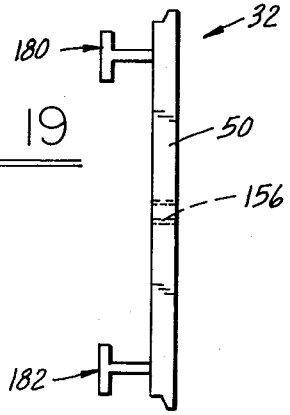

FIG. 19 is a side elevational view of the front plate sub-assembly viewed in the direction of the arrow 19 of FIG. 16.

Figure 1:
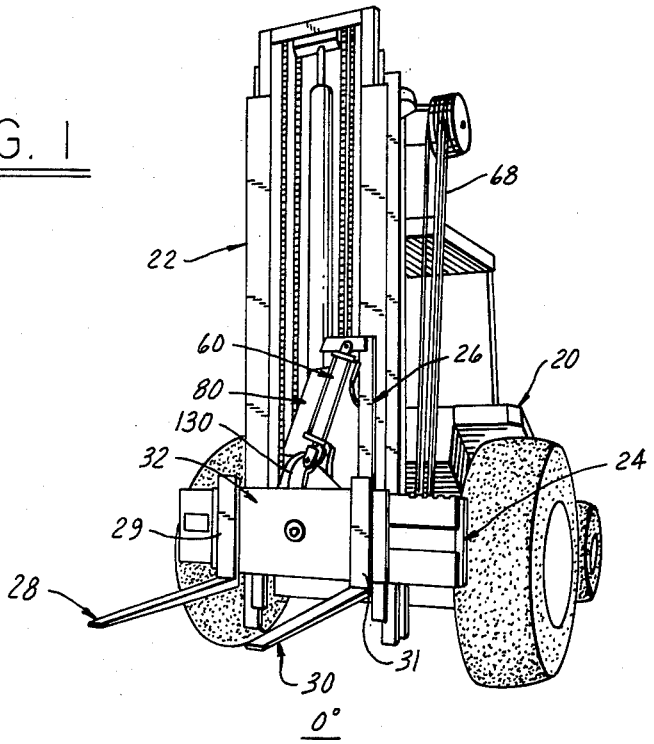
Figure 2:
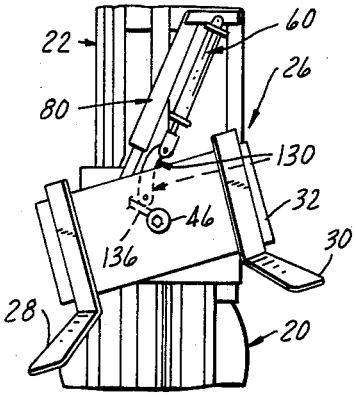
FIGS. 2, 3 and 4 are simplified semi-schematic front elevational views of the lift truck and attachment of FIG. 1 showing how the load rotating attachment rotates from the position of FIG. 1 through a 180° dumping cycle.
Figure 3:
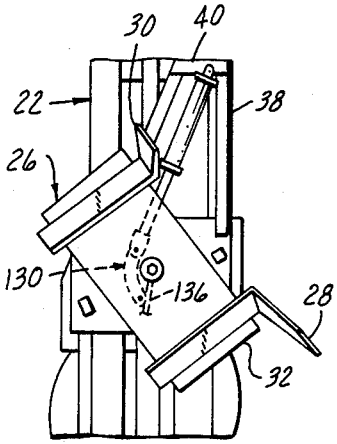
Figure 4:
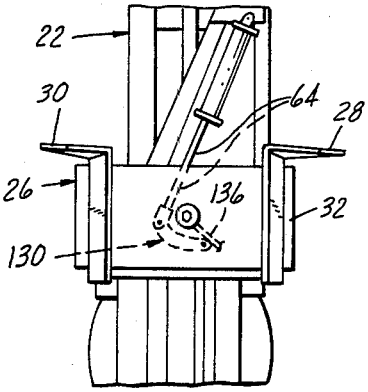

Referring in more detail to the accompanying drawings, FIG. 1 illustrates a conventional rough terrain lift truck 20 with the usual multi-stage extensible lift mast 22 mounted on the front end thereof, the lift truck and mast being provided with the usual vehicle drive and mast powering equipment, including conventional vehicle and mast power controls, hydraulic pressure fluid source(s), hose(s), reel(s) and other associated equipment for raising and lowering a conventional load elevating carriage 24 along the forward side of mast 22. Lift truck 20 is shown with the preferred but exemplary embodiment of the improved load lifting and rotating attachment 26 of the present invention removably mounted on the forward side of carriage 24. A pair of conventional load lifting forks 28 and 30 are detachably mounted on a front plate sub-assembly 32 of attachment 26, the forks being shown in a horizontal zero degree orientation, and slightly raised above the floor or ground surface supporting truck 20, in a typical load transporting attitude.

As will become described in more detail hereinafter, attachment 26 includes its own ram-operated load rotating mechanism which provides smooth hydraulic rotation of forks 28,30 from the zero degree position thereof shown in FIG. 1, to any position in a 180° cycle of rotation. Three stages of such rotation in a right-hand dumping mode are shown in sequence in FIGS. 2, 3 and 4 respectively (counterclockwise as viewed therein), i.e., after the first 20° of rotation in FIG. 2, after the next 110° of rotation (130° from start to position) in FIG. 3, and after the next 50° of rotation (180° or fully inverted from start position) in FIG. 4. For left-hand dumping (as viewed by the lift truck operator) forks 28 and 30 are first detached from the front plate sub-assembly 32 when the same is in the position of FIG. 4, then inverted and reattached so as to hang in the position of FIG. 1, but with the attachment ram and front plate in the FIG. 4 position. The attachment may then be rotated clockwise as viewed in FIGS. 1–4 to return the front plate assembly 32 to the position shown in FIG. 1, thereby rotating forks 28 and 30 to an inverted dumping position corresponding to that of FIG. 4.

In general, the improved load rotating mechanism of the present invention comprises a support which when the mechanism is provided in mast attachment 26 is adapted to be detachably secured to carriage 24, having a pivot mounting means thereon. In the preferred embodiment illustrated herein the support comprises a back plate sub-assembly 34, shown as a separate sub-assembly in FIGS. 9 and 10 and shown in exploded perspective in FIG. 15, including a rectangular upright wall 36 with a superposed framework fixed thereto by welding and extending upwardly therefrom. The framework consists of a vertically extending angle iron or weldment 38, a horizontal top brace 40 fixed to and extending between the upper end of upright 38 and a channel shaped roller track 42 welded at its lower end to the backside of wall 36 and reinforced by a gusset 44. A cylindrical pivot post 46 serves as the pivot mounting means of the support. Post 46 is inserted at one end into a central opening in wall 36 and fixed therein by welding, and has a threaded blind bore 48 opening at its free end.

Attachment 26 further comprises a member rotatably mounted on the support pivot means 46 and adapted to support a suitable load carrier, such as forks 28,30, for bodily load rotation with said rotatable member about the rotational axis of the pivot means. In the preferred embodiment of the invention illustrated herein, this rotatable member comprises a front plate sub-assembly 32 illustrated as a separate sub-assembly in FIGS. 16–19. Front plate sub-assembly 32 comprises a rectangular upright wall 50 having a length somewhat longer, and a height slightly less, than that of back wall 36. A pivot tube 52 is welded at one end in a center through-hole so as to protrude rearwardly from the rear face of wall 50. Tube 52 receives in tandem therein a pair of co-axial bushings 54 and 56 which are journalled on pivot post 46 so as to rotatably support front plate assembly 32 on back plate assembly 34.

Attachment 26 further includes an improved rotating mechanism of the invention operably coupled between said support and said rotatable member for rotating the latter through a 180° dumping cycle. The rotating mechanism in the embodiment illustrated herein comprises a hydraulic ram 60 including a cylinder 62 with a double-acting piston therein connected to a piston rod 64 carrying a clevice 66 at its lower end. Ram 60 is provided with suitable hydraulic connections to hydraulic lines 68 running from lift truck 20 and communicating with its hydraulic supply and control system, such hydraulic connections, lines, valves, controls, etc. being conventional and therefore not shown herein. The upper end of ram 60 has clevice ears 68 and 70 secured to top brace 40 by a mounting pin 72 received through an opening 74 in brace 40 (FIGS. 5, 6, 9 and 15). The lower end of cylinder 62 is fixedly attached to channel 42 by a suitable attachment brace 75 shown in FIGS. 5 and 15. The lower extensible end of ram 60, i.e., clevice 66, is secured by a linkage pin 76 to a leg 78 of a movable guide sub-assembly 80 (FIG. 5) in FIGS. 11–15.

As best seen, guide 80 comprises a roller arm 82 adapted to extend along channel track 42 facing the open side of channel 42 and to overlap the outer side flange 84 thereof along the front of the framework. Leg 78 is welded to the lower arm 82 and braced by a gusset 90 welded to the edge faces of leg 78 and arm 82. Arm 82 is roller mounted on track 42 by a pair of interior rollers 92 and 94 journalled on studs 96 and 98 respectively which in turn are fixed to arm 82 (FIGS. 5 and 11–13). Upper roller 92 has a slight rolling clearance with a wear strip 104 fixed to the inner facing side of the channel flanges 86 of track 42, and tracks on a similar wear strip 102 fixed to flange 84 of channel 42. Lower roller 94 tracks on strip 104 and is clear of strip 102. Further roller guided support of guide 80 is provided by an exterior roller 108 which tracks along the exterior side of channel flange 84 and is supported by a journal fastener 110 threaded at one end into roller 108 and journalled through a sleeve 112 welded to the side edge of arm 82 (FIGS. 5, 11, 14 and 15). A nut 113 is threaded on the other end of journal fastener 110. Guide 80 is also slidably captured on track 42 by an angle clip or bracket 114 fixed by studs 116 to arm 82 and provided with a leg 118 which laps the web 120 of track 42, as best seen in FIGS. 5, 11 and 13.

Guide 80 is thus adapted to provide a moving guide and side-load support for the extensible end of ram 60 for supporting and constraining the same for extension and retraction in a linear travel path tangential to the axis of pivot 46. This travel path is laterally offset from pivot 46 a predetermined distance, as best seen in FIGS. 2–5, such that clevice 66 can travel past pivot 46 in moving between the fully retracted position of piston rod 64 (shown in solid in FIGS. 1 and 5) and its fully extended position shown in FIG. 4.

In accordance with another important feature of the invention, the rotating mechanism of the attachment includes a drive link pivotally coupled between and to the extensible end of ram 60 and rotatable member 32 for bodily travel and pivotal motion in a circular path around and radially offset from said pivot 46. In the embodiment illustrated herein, this drive link comprises a bell crank 130 pivotally connected at its upper end by pin 76 to clevice 66 and guide leg 78. The lower end of crank 130 extends between and is pivotally connected by pin 132 to a pair of spaced ears 134 which in turn are welded to the arm 136 of a roller arm assembly (FIGS. 5 and 16). Arm 136 is welded at one end to sleeve 52 and along one side edge to the rear face of wall 50. The outer end of arm 136 has an extension block 138 welded thereto and to the rear face of wall 50. A pair of spaced ears 140 and 142 are welded to block 138 and receive therethrough a journal pin 144 for rotatably supporting an anti-friction roller 146 between these ears.

Thus, as will be seen from the sequence of part motion sequentially illustrated in FIGS. 5, 2, 3 and 4, the upper end of the drive crank 130 is confined for travel in the linear path of clevice 56 and leg 78 by its pin connection 76 thereto, whereas the lower end of crank 130, due to its pivot pin connection 132 to front plate assembly 32, moves in a circular path of constant radius concentric with the rotational axis of pivot 46. Hence, crank 130 pivots bodily in an orbital entry and exit path partially around and radially offset from the pivotal mounting of front plate assembly 32 upon back plate assembly 34, thereby translating the full linear double-acting working strokes of ram 60 into a full 180° of rotation of front plate assembly 32.

The structure for supporting rotation of front plate assembly 32 on back plate assembly 34 in parallelism further includes a bolt 150 carrying a bearing 152 and washer 154 (FIG. 17) which extends through a central opening 156 in wall 50 (FIG. 19) and is threadably received in threaded bore 48 of pivot post 46. Walls 86 and 50 are further maintained in spaced parallel relation, during relative rotation therebetween anywhere between and through the range from the zero degree to the 180° position of front plate assembly 32 relative to back plate assembly 34, by both roller bearing spacers and slide bearing spacers. Roller 146 serves as one of the roller bearing spacers and is adapted to rotatably bear against front face of back wall 36. Another such bearing spacer roller 156 (FIGS. 16–18) is journalled on pin 158 in turn supported by ears 160 and 162 on arm 164, which, like roller arm 136 is welded to inner face of wall 50 as well as to sleeve 52. Arm 164 is disposed or spaced from arm 136 by an angle of slightly more than 90° (FIGS. 5 and 16), and thus to not have interference with the path of travel of piston rod 64. Rollers 146 and 156 are thus adapted, in conjunction with the bracing reinforcement of arms 136 and 164, to both relieve and brace sleeve 52 against cantilever bending moments which would otherwise be imposed on sleeve 52, bushing 54 and pivot post 46. In addition, a back plate assembly 34 has four spaced slide bearing blocks 170, 172, 174 and 176 affixed thereto, each faced with bronze wear pads 178 adapted to slidably bear against rear face of front wall 50. These spacer blocks, which are disposed near the side edges of wall 36 and clear of the path of travel of friction rollers 146 and 156 and associated structure, also assist in maintaining parallelism of walls 36 and 50 and reduce bending loads on the journal connection between the front and back plate assemblies.

As a further feature of attachment 26 of the invention, the same is provided with additional load supporting and structure at both the zero degree and 180 degree relative positions of the front and back plate assemblies 32 and 34. A pair of T-shaped brackets 180 and 182 are welded to the rear face of front wall 30 near its top and bottom edges respectively (as best seen in FIGS. 16, 18 and 19). In the zero-degree, relatively-rotated position of the front and back plate assemblies of attachment 26 as shown in FIGS. 1, 5, 6 and 7, bracket 180 underlies and abuts an "I-beam" mounting bracket 184 welded to the left-hand side of wall 36 (as viewed in FIGS. 5 and 9). In this position, a T-flange 186 of bracket 180 nests between the front and rear flanges 185 and 187 of bracket 184 and abuts the web 189 thereof, as best seen in FIG. 7. This engagement of brackets 180 and 184 in the zero degree position provides a positive stop against which ram 60 can act to brace the attachment against rotation during transportation of the load on the attachment. Similarly, when the attachment has been rotated to the 180° position of FIG. 4, bracket 182 will come into similar locking engagement with a corresponding bracket 188 fixed to upright 38 adjacent the right hand edge of back wall 36 (FIGS. 5 and 9) to provide lock up and support of the front plate assembly on the back plate assembly in the transport position when the lift forks 28 and 30 have been interchanged for left-hand rotation.

In one working embodiment, the ram stroke is made about ⅛" longer than the design end limits of travel required to produce the 180° rotation, and the ram held pressurized at each end limit to thereby securely hold bracket 180 in abutment with stop 184 or bracket 182 in abutment with stop 188, as the case may be. Also, the T-flange 186 of bracket 180 is designed to have about 1/16" clearance with the front flange 185 of stop 184 in the no-load condition. However, when the forks 28,30 are engaged to lift a load thereon, the load-induced bending moments exerted on the front plate assembly 32 will bring flange 186 into abutment with flange 185. Hence, stop 184 under load lifting and transport conditions serves as a further re-inforcement and support for front plate assembly 32. The same relationship exists between bracket 182 and its associated stop 188.

If desired, guide 80 may be further supported by a block 188 (FIGS. 9 and 15) fixed to the front face of wall 36 and adapted to be slidably engaged by the outer edge of arm 82 during travel thereof near and to its lower end limit of travel. It is also to be understood that attachment 26 is provided with the standard upper and lower carriage engagement lugs 190 and 192 for detachable connection to the upper and lower edges of lift truck carriage 24. Also, as best seen in FIGS. 5 and 16–19, wall 50 is provided with the standard fork engagement notch contour along its upper and lower edges 194 and 196, as well as a set of conventional locking notches 198 in edges 194 and 196, for detachably receiving and locking thereon fork 28 and 30 in either the position shown in FIG. 1 or that shown in FIG. 4.

The preferred working embodiment shown in the accompanying drawings is also provided with ancillary safety features best seen in FIGS. 5, 6, 10 and 16. The front plate wall 50 is provided with a pair of threaded openings 200 and 202 (FIG. 16) near each of the opposite side edges thereof and at mid-height for receiving threaded studs 204 and 206 respectively therein (FIG. 5). After forks 28 and 30 are assembled sidewise onto wall 50 into their properly mounted positions as shown in FIG. 1, and are engaged with their respective locking notches 198, the associated conventional or standard spring-loading locking pin mechanism (not shown) are set to lock the forks to notches 198 to thereby prevent sidewise shifting of the forks. Then studs 204 and 206 are threadably inserted in their respective openings 200 and 202 so that the heads of the studs are disposed adjacent the outside edges of the upright members 31 and 29 of forks 30 and 28 respectively. Studs 204 and 206 thus are positioned to serve as safety stops in the event of inadvertent or accidental release of the associated fork locking mechanism, the studs preventing sidewise slippage of the forks off of the carriage during tilting or inversion of a load on the forks in the load rotating cycle of the mechanism of the invention.

Figure 6:
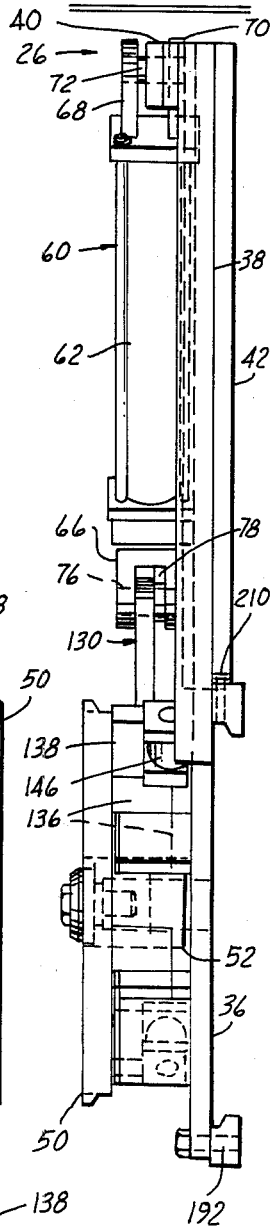
FIG. 6 is a side elevational view of the attachment of FIG. 5.

As another safety feature, each of the upper carriage engagement lugs 190 is provided with a locking stud 210 (FIGS. 5, 6 and 10). Stud 210 is threadably received in a vertically extending threaded through-bore in its associated lug 190. Prior to mounting attachment 26 onto the lift truck carriage 24, studs 210 are screwed upwardly so that the lower end of the stud is withdrawn into the lug bore to permit sidewise sliding of lugs 190 along the upper edge of carriage 24, stud 210 being shown in this position in FIG. 10. Once lugs 190 are properly registered with the carriage 24 in mounted position, studs 210 are threaded downwardly to the position shown in FIG. 6 so as to engage the standard locking notches provided on carriage 24 and thereby lock the attachment against side motion on the carriage. Each of the studs 210 has a lock nut 212 threadably received thereon which is threaded down against the upper surface of lug 190 after the stud is screwed downwardly to the locking position of FIG. 6 to prevent loosening of the safety studs.

It is to be further understood that in addition to the standard lift truck forks 28 and 30, attachment 26 may have other front plate sub-assembly configurations adapted to carry various types of load engagement implements and mechanism, as will be well understood in the art. Also, the load rotating mechanism embodied in attachment 26 may be constructed, if desired, as a permenent portion of various types of material handling equipment rather than as a detachable attachment for use interchangeably with other known standard attachments on the lift truck carriage 24.

From the foregoing description, it will now be apparent the load rotating attachment of the present invention possesses many advantages over known prior art devices of this character. Due to the provision of the movable guide 80, and the dual utilization of one of the uprights 42 of the ram supporting framework as the guide track, ram 60, and particularly piston rod 64 thereof, are relieved of the side loading reaction forces exerted by drive link 130 thereon during load rotation, as well as during the other dynamic and steady-state phases of operation of attachment 26. As a result, ram 60 can be of relatively simple and low cost conventional double-acting design while still providing dependable and long-life operation. This feature also cooperates with the drive link 130 and other foregoing features of the load rotating mechanism of the invention in achieving a full 180° load rotating range embodied in a simple, low-cost and reliable lift truck attachment. The rotating mechanism comprising guide 80 and link 130 also enable relatively close spacing of the front and back plate sub-assemblies 32 and 34, thereby reducing bending stresses imposed upon their mutual pivot connection.

For example, in one successful working embodiment of the invention as illustrated herein, the same has proven in commercial service to provide a dependable, relatively low-cost load rotator capable of full 180° rotation, and thus full load inversion, at less than half the cost of most prior art commercially available load rotators of equal capacity. Attachment 26, in this commercial design, is capable of lifting, rotating and dumping up to a load of 3,000 pounds on a 24" load center, and provides smooth hydraulic operation with no gears or ratchets involved in the mechanism. Attachment 26 can be attached and disconnected to the lift truck carriage 24 by one man and the same can be used on both conventional and rough terrain fork lift trucks. Right to left rotation is readily available by the truck operator detaching, inverting and reattaching forks 28 in the field. In addition, attachment 26 allows nesting and stacking of loads by the truck operator from the driver's seat while the forks are positioned at the 180° position. With the attachment lock up features, loads may be safely lifted and transported with the attachment securely stabilized and supported.

It is also to be understood that the terminology as employed in the description and claims incorporated herein, such as "upper", "lower", "left", "right", "front", "rear", etc., is used by way of description, and not by way of limitation, to facilitate understanding of the structure, function and operation of the combination of elements which constitute the present invention. Moreover, while the foregoing description and drawings illustrate in detail one successful working embodiment of my invention, to those skilled in the art to which my invention relates the present disclosure will suggest many modifications in construction as well as widely differing embodiments and applications without thereby departing from the spirit and scope of the invention. The present invention, therefore, is intended to be limited only by the scope of the appended claims and the applicable prior art.

I claim:

1. A load rotating mechanism comprising a support having pivot mounting means thereon, a member rotatably mounted on said support pivot means and adapted to support a load carrier for bodily rotation thereof with said rotatable member about the rotational axis of said pivot means, and rotating mechanism including power drive means operably coupled between said support and said rotatable member for rotating the latter, said rotating mechanism including stationary guide means fixed to said support, movable guide means movable by said power drive means along said stationary guide means in a travel path tangential to said axis and laterally offset therefrom, and a drive link pivotally coupled between and to said movable guide means and to said rotatable member for bodily travel and pivotal motion in a path extending partially around and radially offset from said pivot mounting means.

2. The mechanism as set forth in claim 1 embodied in an attachment for a lift truck provided with an elevating carriage, said support comprising a back plate sub-assembly adapted to be secured to the carriage and having an upright wall adapted to be supported adjacent and forward of the carriage, said support also including an upright framework fixed to and extending above said wall and means on said framework for supporting said power drive means, said stationary guide means comprising a fixed upright member of said framework serving as a guide track for said movable guide means, said track extending along the path of movement of said pivot coupling of said drive link to said movable guide means.

3. The mechanism as set forth in claim 2 wherein said framework guide track comprises a channel beam and said movable guide means comprises a roller arm having guide rollers supported thereon for tracking on said channel beam, said roller arm being pivotally connected to said drive link.

4. The mechanism as set forth in claim 3 wherein said power drive means comprises a double-acting cylinder and piston ram assembly mounted on said framework and pivotally coupled to said movable guide means.

5. The mechanism set forth in claim 4 wherein said extensible end of said ram, said drive link and said roller arm are pivotally interconnected by a common pivot pin.

6. The mechanism as set forth in claim 5 wherein said framework power drive support means comprises said guide track, a second framework upright extending upwardly from said back plate and a cross brace connected to and extending between said uprights, and means connecting the cylinder of said ram to said cross brace and to said framework guide track with said ram cylinder in fixed position with its axis extending parallel to said guide track.

7. The mechanism as set forth in claim 2 wherein said rotatable member comprises a front plate sub-assembly having an upright wall juxtaposed to said back plate wall, said pivot mounting means comprising a pivot post and cooperating sleeve bearing mounted centrally between and to said front and back plate walls and operable to support said walls for relative rotation with the major planes of said walls in parallelism.

8. The mechanism as set forth in claim 7 wherein said front and back plate walls have spacing means disposed therebetween fixed to one of said walls and movably engaged with the other of said walls for maintaining said walls generally in parallelism against load induced bending moments exerted on said front plate assembly.

9. The mechanism as set forth in claim 8 wherein said wall spacing means includes a roller arm fixed to the rear side of said front plate wall and carrying a spacing roller thereon having rolling engagement with the front face of said back plate wall, said drive link being pivotally connected to said roller arm.

10. The mechanism as set forth in claim 9 wherein said wall spacing means includes a second roller arm fixed to the rear face of said front plate wall, said roller arms being connected to said journal means to help brace the same and being angularly spaced relative to one another at an included angle of less than 180° whereby said second roller arm remains clear of the path of motion of said rotating mechanism through the rotational range of said front and back plate sub-assemblies relative to one another.

11. The mechanism as set forth in claim 7 wherein said front and back plate assemblies include first and second abutment means for supporting said sub-assemblies against relative rotation therebetween and being interengagable at each of the end limits of the range of relative rotation imparted to said sub-assemblies by said rotating mechanism.

12. The mechanism as set forth in claim 11 wherein said load carrier comprises a pair of load engaging forks detachably mounted upon said front plate wall in mounted positions spaced inwardly from the outer side edges of said front plate wall, and further including safety stop means removably mounted to said front plate wall adjacent and outwardly of an associated fork to prevent sidewise disengagement of the associated fork from the front plate wall during load rotation.

13. The mechanism as set forth in claim 12 wherein said back plate sub-assembly is provided with mounting means for detachably securing said back plate wall to the lift truck carriage, said mounting means including mounting lugs and associated fastener means movable between a carriage release position and a carriage engagement position for locking said back plate sub-assembly against side motion relative to said carriage.

14. A load rotating mechanism comprising a support having pivot mounting means thereon, a member rotatably mounted on said support pivot means and adapted to support a load carrier for bodily rotation thereof with said rotatable member about the rotational axis of said pivot means, and rotating mechanism including power drive means operably coupled between said support and said rotatable member for rotating the latter, said rotating mechanism including drive means movable by said power drive means along a travel path trangential to said axis and laterally offset therefrom, and a drive link pivotally coupled between and to said movable drive means and to said rotatable member for bodily travel and pivotal motion in a path extending partially around and radially offset from said pivot mounting means.

15. The mechanism as set forth in claim 14 embodied in an attachment for a lift truck provided with an elevating carriage, said support comprising a back plate sub-assembly adapted to be secured to the carriage and having an upright wall adapted to be supported adjacent and forward of the carriage, said support also including an upright framework fixed to and extending above said wall and means on said framework for supporting said power drive means.

16. The mechanism as set forth in claim 15 wherein said power drive means comprises a double-acting cylinder and piston ram assembly mounted on said framework and pivotally coupled to said movable drive means.

17. The mechanism set forth in claim 16 wherein said extensible end of said ram and said drive link are pivotally interconnected by a common pivot pin.

18. The mechanism as set forth in claim 17 wherein said rotatable member comprises a front plate sub-assembly having an upright wall juxtaposed to said back plate wall, said pivot mounting means comprising a pivot post and cooperating sleeve bearing mounted centrally between and to said front and back plate walls and operable to support said walls for relative rotation with the major planes of said walls in parallelism, said ram assembly being operable through a working stroke to move said drive link through said path of movement thereof sufficient to cause said front plate wall to rotate through at least 180° relative to said back plate wall to thereby provide a zero degree position of said front plate wall and a 180° position thereof, said load carrier comprising a pair of load engaging forks detachably mounted upon said front plate wall, each said fork having an arm extending forwardly from said front plate wall for supporting a load resting thereon, said arm being cantilevered from an upright member of said fork having means adapted to engage said front plate wall, said front plate wall having spaced parallel first and second fork mounting means thereon and extending horizontally in the zero and 180° positions of said front plate wall, said wall engagement means of said fork upright members being detachably connectable to said first fork mounting means of said front wall in the zero degree position thereof with said fork upright members dependent downwardly therefrom for supporting a load on the forks for rotation in a given rotational direction, said wall engagement means of said fork upright members being detachably connectable to said second fork mounting means of said front wall in the 180° position thereof with said fork upright members dependent downwardly therefrom for supporting a load on the forks for rotation in a direction opposite to said given direction.

19. The mechanism as set forth in claim 18 wherein said front and back plate walls have spacing means disposed therebetween fixed to one of said walls and movably engaged with the other of said walls for maintaining said walls generally in parallelism against load induced bending moments exerted on said front plate assembly.

* * * * *